US011406564B2

(12) United States Patent
Davies et al.

(10) Patent No.: US 11,406,564 B2
(45) Date of Patent: Aug. 9, 2022

(54) DRUG PREPARATION KIT AND PROCESS OF PREPARING A DRUG

(71) Applicant: HOFFMANN-LA ROCHE INC., Little Falls, NJ (US)

(72) Inventors: Geraint Iwan Davies, Basel (CH); Guillaume Gerard, Biederthal (FR)

(73) Assignee: HOFFMANN-LA ROCHE INC., Little Falls, NJ (US)

( * ) Notice: Subject to any disclaimer, the term of this patent is extended or adjusted under 35 U.S.C. 154(b) by 9 days.

(21) Appl. No.: 16/610,706

(22) PCT Filed: May 4, 2018

(86) PCT No.: PCT/EP2018/061483
§ 371 (c)(1),
(2) Date: Nov. 4, 2019

(87) PCT Pub. No.: WO2018/202843
PCT Pub. Date: Nov. 8, 2018

(65) Prior Publication Data

US 2020/0146936 A1 May 14, 2020

(30) Foreign Application Priority Data

May 5, 2017 (EP) ..... 17169798

(51) Int. Cl.
*A61J 1/20* (2006.01)
*A61J 7/00* (2006.01)
*A61J 15/00* (2006.01)

(52) U.S. Cl.
CPC ..... *A61J 1/2075* (2015.05); *A61J 1/2048* (2015.05); *A61J 7/0053* (2013.01); *A61J 15/0026* (2013.01)

(58) Field of Classification Search
CPC ..... A61J 1/2096; A61J 1/2075; A61J 1/2089
(Continued)

(56) References Cited

U.S. PATENT DOCUMENTS 1,705,312 A 3/1929 Rovano
3,973,602 A * 8/1976 Kruse ..... B67C 11/02 141/95
(Continued)

FOREIGN PATENT DOCUMENTS

CN 101068585 A 11/2007
CN 102458538 A 5/2012
(Continued)

OTHER PUBLICATIONS

International Search Report dated Jun. 29, 2018 in corresponding International Patent Application No. PCT/EP2018/061483.
(Continued)

*Primary Examiner* — Timothy P. Kelly
(74) *Attorney, Agent, or Firm* — Medler Ferro Woodhouse & Mills PLLC

(57) ABSTRACT

A drug preparation kit is disclosed that includes an adapter and a funnel unit. The adapter has a stud section with an in-container side and an out-container side. The stud section of the adapter is dimensioned to tightly fit into an opening of a container. The adapter has an access passage extending from the out-container side to the in-container side through the stud section. The funnel unit has a neck portion dimensioned to tightly fit into the access passage of the adapter. The funnel unit has a degassing channel formation arranged to provide a degassing channel extending from the in-container side of the stud section of the adapter to the out-container side of the stud section of the adapter when the neck portion of the funnel unit is fitted into the access passage of the adapter.

14 Claims, 5 Drawing Sheets

Fig. 6

(58) Field of Classification Search
USPC ..... 141/331–345
See application file for complete search history.

(56) References Cited

U.S. PATENT DOCUMENTS

| | | | | |
|---|---|---|---|---|
| 4,058,121 | A | 11/1977 | Choksi et al. | |
| 5,874,048 | A * | 2/1999 | Seto | G01N 35/1002 422/519 |
| 8,196,614 | B2 | 6/2012 | Kriheli | |
| 10,604,369 | B2 * | 3/2020 | Nakano | B65H 29/125 |
| 2005/0155901 | A1 * | 7/2005 | Krueger | A61B 17/8833 206/571 |
| 2006/0079834 | A1 | 4/2006 | Tennican et al. | |
| 2008/0015539 | A1 * | 1/2008 | Pieroni | A61J 1/2096 604/403 |
| 2009/0318893 | A1 | 12/2009 | English | |
| 2010/0204670 | A1 * | 8/2010 | Kraushaar | A61J 1/2096 604/414 |
| 2012/0157928 | A1 | 6/2012 | Mermet | |
| 2012/0267005 | A1 | 10/2012 | Smith et al. | |
| 2013/0030379 | A1 * | 1/2013 | Ingram | A61M 39/10 604/218 |
| 2018/0099791 | A1 * | 4/2018 | Doornbos | A61J 1/1487 |

FOREIGN PATENT DOCUMENTS

| | | | |
|---|---|---|---|
| CN | 205126867 | U | 4/2016 |
| JP | S60-99299 | U | 7/1985 |
| JP | 2013066748 | A | 4/2013 |
| WO | 2010/093581 | A2 | 8/2010 |
| WO | 201605139 | A1 | 4/2016 |

OTHER PUBLICATIONS

Office Action dated Jan. 17, 2022 in Japanese Patent Application No. 2019-560656.
Search Report dated Dec. 22, 2021 in Japanese Patent Application No. 2019-560656.
Chinese Office Action issued in corresponding Chinese Application No. 201880029536.2 dated Jan. 30, 2022.

* cited by examiner

DRUG PREPARATION KIT AND PROCESS OF PREPARING A DRUG

TECHNICAL FIELD

The present invention relates to a drug preparation kit and its use as well as to a process of preparing a highly potent drug product.

BACKGROUND ART

Many pharmaceutical products (below referred to as drugs) are processed and/or administered in liquid form. For example, in many therapeutic applications injecting the drug is most efficient and preferred. In other applications, drugs are orally or gastro-enterally delivered by means of dispensers such as syringes or appropriate tubes.

For storing, shipping and preparing, the drugs are typically filled into containers such as in vials, bottles or the like. Also, since many drugs and particularly biopharmaceuticals are frequently highly unstable in liquid form they are often provided in a solid form such as in a lyophilized, crystalline, amorphous form as a powder or the like. In solid form they may be essentially more stable and robust compared to their liquid forms. The solid drugs typically are also filled and provided in containers which may be closed by a child resistant closure (CRC).

Before being administered to patients in liquid form, the drug solution is extemporaneously reconstituted by dissolution of the solid drug in a solvent. More particularly, usually the container enclosing the solid drug is opened and the solvent is filled into the container via an opening thereof. The container may be closed again and shaken for achieving a liquid reconstitution of the complete drug content of the container. After reconstitution, the liquid drug product is withdrawn into a dispenser and delivered to the patient by means of the dispenser.

When reconstituting drug solutions, it may be of major relevance that an accurate concentration of the drug in solution is obtained. In particular, if the amount of solvent is too high for the amount of solid, the concentration of the pharmaceutically active substance of the drug in the solution might be low, such that the dosage delivered to the patient might be unsatisfying or ineffective. In contrast, if the amount of solvent is too low, the concentration of the pharmaceutically active substance in the solution might be high and the dosage delivered to the patient also too high or too concentrated. Therefore, it is desired to allow provision of a precise amount of solvent into the container via its opening but also to prevent, during reconstitution, any spillage of solid or of the fraction of the drug that is already in liquid form.

Furthermore, it should usually be avoided that the person reconstituting the solid pharmaceutical is exposed to the drug, in particular by inhalation. This can be more particularly relevant when highly potent pharmaceuticals are involved for which any exposure is to be prevented.

For example, typically during reconstitution, gases are set free which exit the containers via their openings. Thereby, particularly when the gases may not freely exit the container, they may cause turbulences inside the container and carry some drug in solid or liquid form out of the container.

Therefore, there is a need for a system or process allowing to accurately and safely prepare or reconstitute a drug product in liquid form in a container. In particular, a system that reduces the exposure to inhalation hazards when reconstituting a drug product is still desired.

DISCLOSURE OF THE INVENTION

According to the invention this need is settled by a kit as it is defined by the features of independent claim 1, by a process as it is defined by the features of independent claim 16 and by a use as it is defined by the features of independent claim 17. Particular embodiments are subject of the dependent claims.

In particular, the invention deals with a drug preparation kit comprising an adapter and a funnel unit. The adapter has a stud section with an in-container side and an out-container side. The adapter comprises an access passage extending from the in-container side to the out-container side through the stud section. The funnel unit has a neck portion dimensioned to fit into the access passage of the adapter. Further, the funnel unit has a degassing channel formation arranged to provide a degassing channel extending from the in-container side of the stud section of the adapter to the out-container side of the stud section of the adapter when the neck portion of the funnel unit is fitted into the access passage of the adapter.

The funnel unit is a single-piece part or multi-piece part which simplifies pouring of a fluid in a comparably narrow structure. In particular, the funnel unit can ease the provision of a liquid through the opening of the container into the container. Thereby, the funnel unit can particularly be a funnel or a similar device.

The term "drug" as used herein relates to a therapeutically active substance, also commonly called active pharmaceutical ingredient (API), as well as to a plurality of such therapeutically active substances. The term also encompasses diagnostic or imaging agents, like for example contrast agents (e.g. MRI contrast agents), tracers (e.g. PET tracers) and hormones, that need to be administered in liquid form to the patient.

The term "drug product" as used herein relates to a drug as defined above formulated or reconstituted in a form that is suitable for administration to the patient. A particularly preferred drug product according to the invention is a drug solution, in particular a solution for oral administration, injection or infusion.

The container can be a vial or a bottle. It can particularly be made of a biocompatible and sterilizable material such as glass or a plastic, e.g. polypropylene, or the like. The term "vial" as used herein can relate to vials in the literal sense, i.e. a comparably small vessel or bottle, often used to store pharmaceutical products or pharmaceuticals or medications in liquid, powdered or capsuled form.

The term "fit into" in connection with the neck portion of the funnel unit and the access passage of the container can relate to the neck portion being arranged in the access passage such that it is connected to or held by the access passage. Thereby, the neck portion is advantageously dimensioned to tightly fit into the access passage such that an at least partially sealed connection between funnel unit and adapter can be achieved. In particular, the neck portion can tightly fit into the access passage by contacting the access passage over its complete circumference or over a section of its circumference.

The degassing channel formation of the funnel unit is embodied such that a degassing channel is formed when the adapter and the funnel unit are mounted to the container. In particular, such degassing channel can be separated from the main duct of the funnel unit through which a liquid is provided into the container. For example, the degassing channel can be formed between the neck portion of the funnel unit and the access passage of the adapter. In such embodiments the neck portion typically contacts the access passage over a section of its circumference. Alternatively, the degassing channel can be arranged inside the neck portion. In such embodiments, the neck portion may contact the access passage over its complete circumference. Thereby, the excess of gas that is replaced by the liquid when said liquid is poured into the container can freely exit the container. Like this, any excess of gas produced when reconstituting a drug product inside the container can escape the bottle through the degassing channel without generating turbulences inside the container and without impeding the inflow of the liquid into the container. This allows for a controlled reconstitution or preparation of the drug product inside the container. The risk of the drug in solid form or drug product in liquid form exiting the container can be reduced or even eliminated. Exposure to the drug, e.g., by contact, inhalation, or spillage of the drug either in liquid or solid form can be reduced or even eliminated. Thus, the kit according to the invention allows for accurately and safely preparing the drug product in the container.

The term "solid" as used in connection with the drug relates to a state of matter characterized by structural rigidity and resistance to changes of shape or volume. It can particularly, be related to a drug being soluble in a liquid. The solid drug can be of particulate consistency such as a powder a granulate or the like. For example, the solid drug can be a powder generated by lyophilization.

The degassing channel formation of the funnel unit can be embodied by shaping the funnel unit in an appropriate way such that a free space is provided between the funnel unit and the access passage of the adapter when the funnel unit and the adapter are connected, said free space extending at least from the in-container side to the out-container side, so that the gas can flow from the inside to the outside of the container. For example, the funnel unit may have a neck which is intended to be arranged through the access passage. By shaping the neck with, e.g., a flattened section or a notch, the degassing channel can be formed between the neck and the access channel. Alternatively, the degassing channel formation can have a complete channel itself. Such channel can, e.g., be formed in parallel to the main duct of the funnel unit via which the liquid is to be provided into the container.

Advantageously, the funnel unit can have a seat adapted to stably hold the funnel unit on the adapter, when the neck portion of the funnel unit is fitted into the access passage of the adapter. Such a seat increases safety and convenience when using the funnel unit. In particular, it allows for holding the funnel unit in an upright position such that a liquid can be easily and safely poured through it without tilting the funnel unit or dropping it from the adaptor.

The funnel unit can have advantageously a cone portion being essentially frustum conically shaped. Such a cone portion allows for providing a comparably wide open end. This allows the funnel unit conveniently be accessed. More specifically, by having a cone portion the funnel unit may widen upwards from the end to be connected to the adapter. Thus, the portion of the funnel unit where the liquid is to be filled can be comparably large such that the liquid can conveniently be filled and spillage of the liquid can be prevented.

The adapter can be arranged to be tightly connected to the container in any appropriate manner. For example, it can have a screw structure corresponding to a thread of the container wherein the adapter can be connected to the container by being screwed onto it. Advantageously, the stud section of the adapter can have a press-fit structure dimensioned and arranged to be tightly pressed into the opening of the container.

The term "press-fit" as used in this connection can relate to a fastening or connecting between two parts which is achieved by friction after the parts are pushed together. Press-fit is often achieved by embodying one of the two parts to be elastically deformable such that it is deformed when the two parts are connected and such that it applies pressure to the other part when being deformed.

In particular, the adapter can be a Press In Bottle Adapter (PIBA). Such PIBA allows for a fast, convenient and safe usage. In operation, it can simply be pressed into the opening of the container thereby providing a seal connection and secured arrangement.

Advantageously, the stud section of the adapter can be essentially cylindrical. Such cylindrical stud section allows the adapter being used with many types of containers. It also allows for a convenient handling of the adapter since the orientation of the adapter does not have to be considered when the adapter is mounted to the container.

Preferably, the access passage of the adapter is ENFit® compliant or Luer Lock compliant. In this connection, the term ENFit® relates to the trademark for connectors in accordance with DIN EN ISO 80369-3. The term "Luer Lock" relates to connectors in accordance with DIN EN 20594-1. Since ENFit® or Luer Lock compliant connectors are provided in many syringes, gastric tubes, enteral tubes and similar dispensers, such an adapter allows for being efficiently used with many types of dispensers.

Advantageously, the drug preparation kit can comprise a container with an opening, wherein the stud section of the adapter is dimensioned to fit into the opening of the container. Thereby, the container can be advantageously a bottle or a vial.

The term "fit into" in connection with the stud section of the adapter and the opening of the container can relate to the stud section being arranged in the opening such that the stud section is connected to or held by the opening. Thereby, the stud section is advantageously dimensioned to tightly fit into the opening such that a sealed connection between adapter and container can be achieved.

The drug preparation kit advantageously can comprise a solid active pharmaceutical ingredient, e.g. in powder form, arranged inside the container. Thereby, it advantageously can further comprise a reconstitution medium for reconstituting the drug product. The reconstitution medium can be any medium appropriate for reconstituting the specific drug product. Typically, such medium is a liquid capable of dissolving the drug such as water or the like. By providing the kit with the appropriate reconstitution medium, the risk of misuse is minimized. In particular, it can be prevented that the drug is reconstituted with an inappropriate liquid. Also, the amount of reconstitution medium can be predefined to suit the requirements of the medical application.

Thereby, the reconstitution medium preferably is controlled water. The term "controlled water" in this context can relate to purified water which particularly can exclude or essentially exclude cations. The amount of reconstitution medium can be in a range of from about 10 milliliter (ml) to about 200 ml, from about 30 ml to about 150 ml and from about 50 ml to about 100 ml. It can particularly be about 80 ml.

The drug can be a highly potent drug. The term "potency" in this context can be a measure of drug activity expressed in terms of the amount required to produce an effect of given intensity. Thus, the term "highly potent" can relate to a substance which is active at comparably small amounts or dosages. In other word, a highly potent drug can evoke a given response at comparably low concentrations, while a drug of lower potency can evoke the same response only at higher concentrations. The potency may depend on both the affinity and efficacy of the drug. Thereby, such drugs or substances can be particularly problematic since comparably small variations in dosing or comparably small contaminations can be comparably effective.

A highly potent drug can be defined as a drug having a biological activity at approximately 15 micrograms (μg) per kilogram (kg) of body weight or below in humans. This is equivalent to a therapeutic dose at approximately 1 milligrams (mg) or below in humans.

The highly potent drug can thus be defined as a drug having an inhalative Acceptable Daily Exposure (ADE) value of 1.5 μg/d or less, translating into an Indicative Occupational Exposure Limit (IOEL) value of 0.15 $\mu g/m^3$.

In particular, the highly potent drug product can be a class 3B drug or the like. When used with highly potent drugs the drug preparation kit can be particularly beneficial.

The invention can reduce the exposure to or risk of inhalative hazard.

Advantageously, the drug preparation kit can comprise a dispenser adapted to be coupled to the access passage of the adapter for withdrawing a content of the container. Thereby, the dispenser can be in particular a syringe such as an oral syringe, an enteral tube or a gastric tube. With such a dispenser many drugs can efficiently be administered. By including the dispenser into the kit it can be embodied to particularly suit to the other parts of the kit. Thus, the kit can allow for a convenient, accurate and safe administration of the drug.

A further aspect of the invention relates to a process of preparing a highly potent drug product. The process comprises the steps of: obtaining a powder of the highly potent drug in a container with an opening; fitting an adapter into the opening of the container, wherein the adapter has a stud section with an in-container side and an out-container side which stud section being dimensioned to tightly fit into the opening of the container, and an access passage extending from the in-container side to the out-container side through the stud section; fitting a neck portion of a funnel unit into the access passage of the adapter; and providing a reconstitution medium into the container via the funnel, wherein the funnel has a degassing channel formation arranged to extend from the in-container side of the stud section of the adapter to the out-container side of the stud section of the adapter such that a gas can exit the container during reconstitution of the drug product inside the container via the degassing channel.

Another further aspect of the invention relates to the use of a drug preparation kit as described above to prepare a drug product, in particular a highly potent drug product.

The process according to the invention and the use according to the invention allow for efficiently achieving the effects and benefits described above in connection with the drug preparation kit according to the invention and its preferred embodiments.

BRIEF DESCRIPTION OF THE DRAWINGS

The drug preparation kit, the process of preparing a drug product and the use of the preparation kit according to the invention are described in more detail herein below by way of an exemplary embodiment and with reference to the attached drawings, in which.

DESCRIPTION OF EMBODIMENTS

In the following description certain terms are used for reasons of convenience and are not intended to limit the invention. The terms "right", "left", "up", "down", "under" and "above" refer to directions in the figures. The terminology comprises the explicitly mentioned terms as well as their derivations and terms with a similar meaning. Also, spatially relative terms, such as "beneath", "below", "lower", "above", "upper", "proximal", "distal", and the like, may be used to describe one element's or feature's relationship to another element or feature as illustrated in the figures. These spatially relative terms are intended to encompass different positions and orientations of the devices in use or operation in addition to the position and orientation shown in the figures. For example, if a device in the figures is turned over, elements described as "below" or "beneath" other elements or features would then be "above" or "over" the other elements or features. Thus, the exemplary term "below" can encompass both positions and orientations of above and below. The devices may be otherwise oriented (rotated 90 degrees or at other orientations), and the spatially relative descriptors used herein interpreted accordingly. Likewise, descriptions of movement along and around various axes includes various special device positions and orientations.

To avoid repetition in the figures and the descriptions of the various aspects and illustrative embodiments, it should be understood that many features are common to many aspects and embodiments. Omission of an aspect from a description or figure does not imply that the aspect is missing from embodiments that incorporate that aspect. Instead, the aspect may have been omitted for clarity and to avoid prolix description. In this context, the following applies to the rest of this description: If, in order to clarify the drawings, a figure contains reference signs which are not explained in the directly associated part of the description, then it is referred to previous or following description sections. Further, for reason of lucidity, if in a drawing not all features of a part are provided with reference signs it is referred to other drawings showing the same part. Like numbers in two or more figures represent the same or similar elements.

Figure 1:
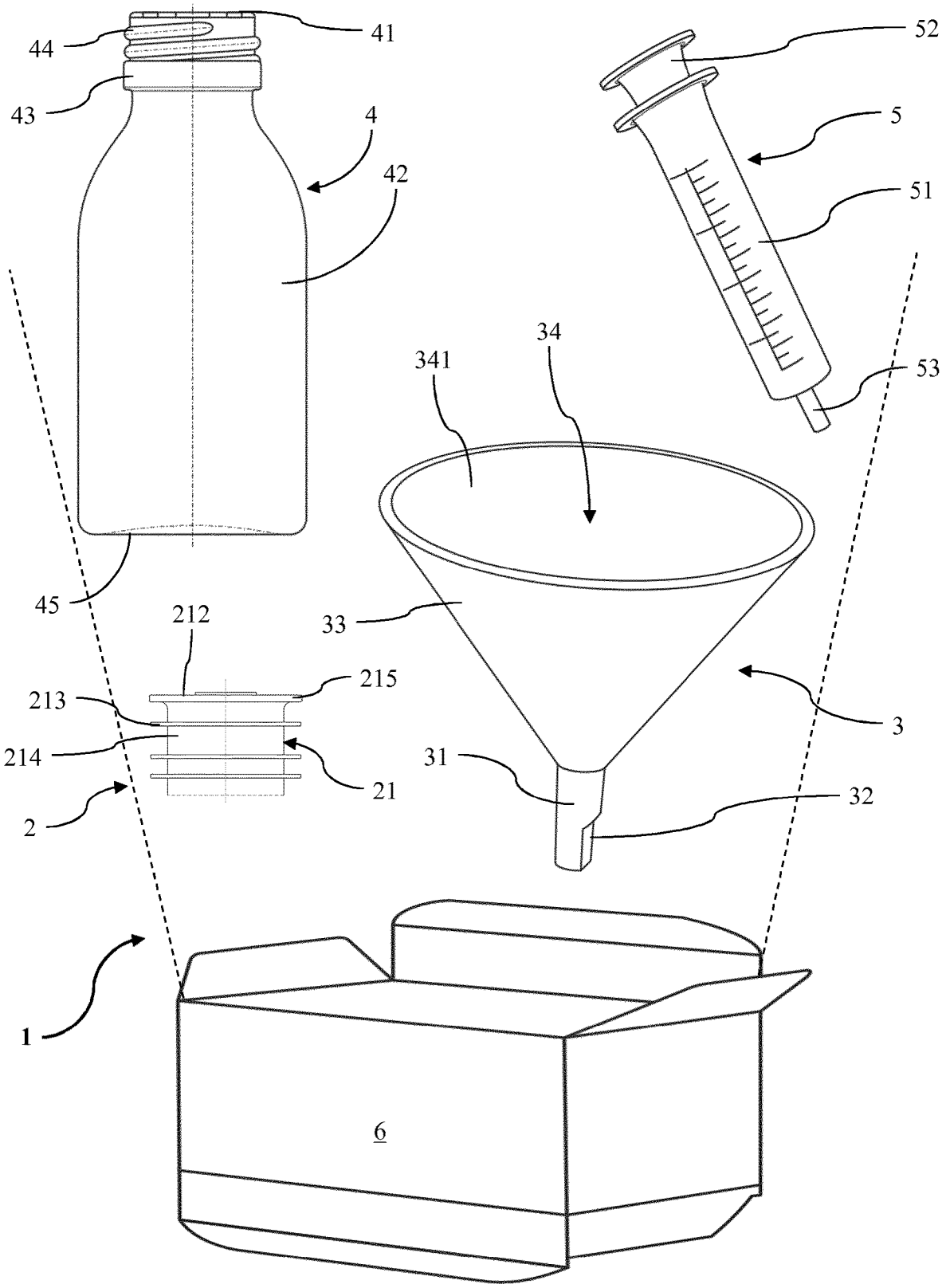
FIG. 1 shows a first embodiment of a drug preparation kit according to the invention.

FIG. 1 shows a first embodiment of a drug preparation kit 1 according to the invention. The kit 1 comprises a plastic adapter 2, a funnel 3 as funnel unit, a glass bottle 4 as container, a syringe 5 as dispenser and a box 6. The box 6 is shaped and dimensioned to house all the other components of the kit 1 as well as a container with an appropriate amount of reconstitution medium (not visible in the Figs.).

Figure 2:
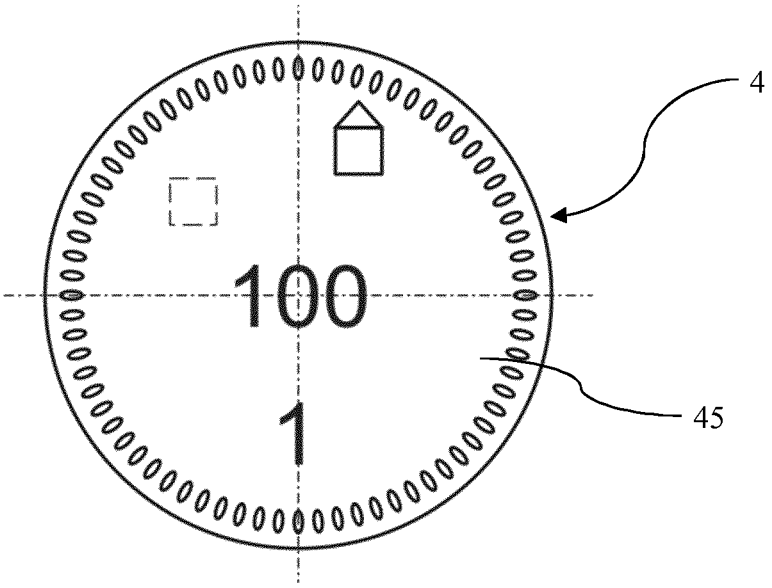
FIG. 2 shows a bottom view of a bottle of the drug preparation kit of FIG. 1.

The bottle 4 is made of glass and has a body 42, a bottom 45, a neck 43 neighbouring the body 42 opposite to the bottom 45 and an outer thread 44 at a periphery of the neck 43. As can be seen in FIG. 2 the bottom 45 has a circular shaped base and the body 42 is essentially circular cylindrical.

Turning back to FIG. 1, the neck 43 forms an opening 41 at the top end of the bottle 4 through which an interior of the body 42 is accessible. The thread 44 is a portion of a child resistant closure (CRC) which additionally comprises a cap (not visible in the Figs.) for closing the opening 41 of the bottle 4. In the interior of the body 42 a solid high potent drug is arranged.

The adapter 2 has a stud section 21 with an in-container side 211 (not visible in FIG. 1) and an out-container side 212. The stud section 21 comprises a cylinder portion 214 and three ring shaped and axially spaced press fit projections 213 outwardly extending from the cylinder portion 214 as press-fit structure. At its top end the stud section 21 is equipped with a disk shaped lid portion 215 which also outwardly projects from the cylinder portion 214 to a similar extent as the press fit projections 213.

The stud section 21 of the adapter 2 is dimensioned to tightly fit into the opening 41 of the bottle 4. In particular, the press fit projections 213 are dimensioned to be slightly deformed when the adapter 2 is pressed into the opening 41 of the bottle 4. Thereby, the press fit projections 213 tightly seal and close the opening 41. Like this the adapter 2 is embodied as a press in bottle adapter (PIBA). When being completely pressed into the opening 41 of the bottle 4 the lid portion 215 of the stud section 21 abuts the upper end or border of the opening 41.

Figure 3:
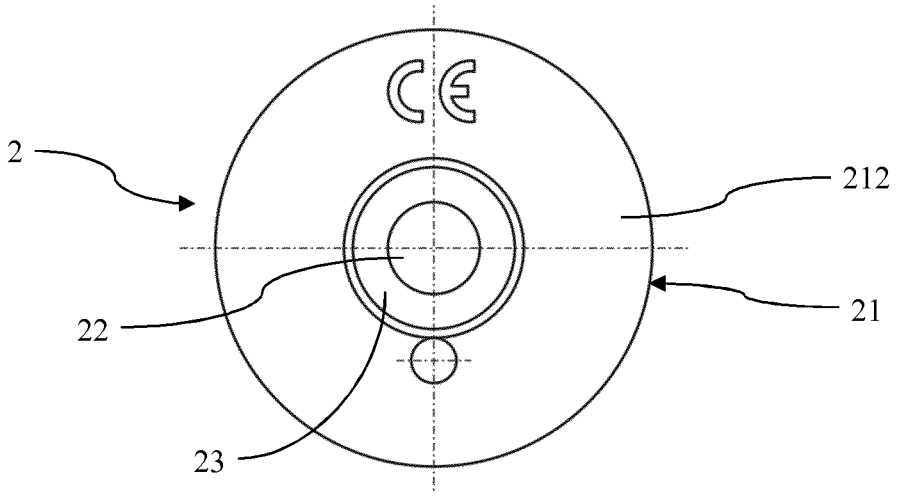
FIG. 3 shows a top view of an adapter of the drug preparation kit of FIG. 1.
Figure 4:
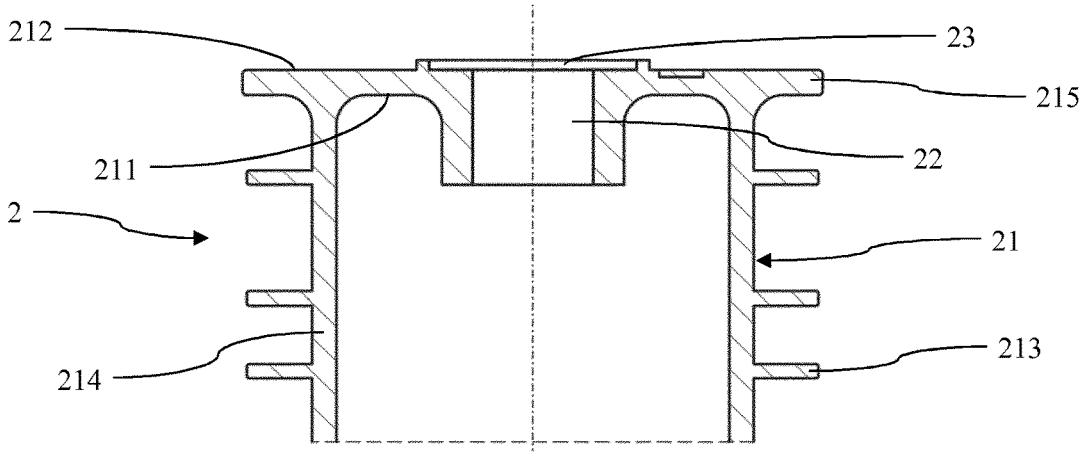
FIG. 4 shows a cross sectional view of the adapter of FIG. 3.

As can be seen in FIG. 3 and FIG. 4 illustrating a top view and a cross section of the adapter 2, the adapter 2 has a vertical central access passage 22 which is closed at its top end by a septum 23. The in-container side 211 of the stud section 21 is particularly formed by the lower or inner surface of the lid portion 215. When the adapter 2 is mounted onto the bottle 4, the in-container side 211 is adjoining the opening 41 of the bottle 4 and, thus, oriented towards the interior of the bottle 4. The opposite upper surface of the lid portion 215 forms the out-container side 212 of the stud section 21 which is oriented away from the interior of the bottle 4. The access passage 23 extends from the in-container side 211 to the out-container side 212 through the lid portion 215 of the stud section 21.

Turning back to FIG. 1, the funnel 3 has an upper cone portion 33 and a lower neck portion 31. The cone portion 33 is frustum conically shaped and narrows in a downward direction towards the neck portion 31. The interiors of the cone portion 33 and the neck portion 31 form a main duct 34 which has a wide input aperture 341 at its top end and a narrow output aperture at its bottom end. Starting from the bottom end of the neck portion 31 and extending about up to half way of the neck portion 31 a degassing channel formation 32 is embodied. More specifically, the neck portion 31 is provided with a planar surface as the degassing channel formation 32. The neck portion 31 is thereby not entirely circle cylindrical at its lower half.

The syringe 5 is conventionally embodied with a syringe body 51 into which a plunger rod 52 extends on one longitudinal end side and which passes over into a dispensing orifice 53 at another longitudinal end side.

Figure 5:
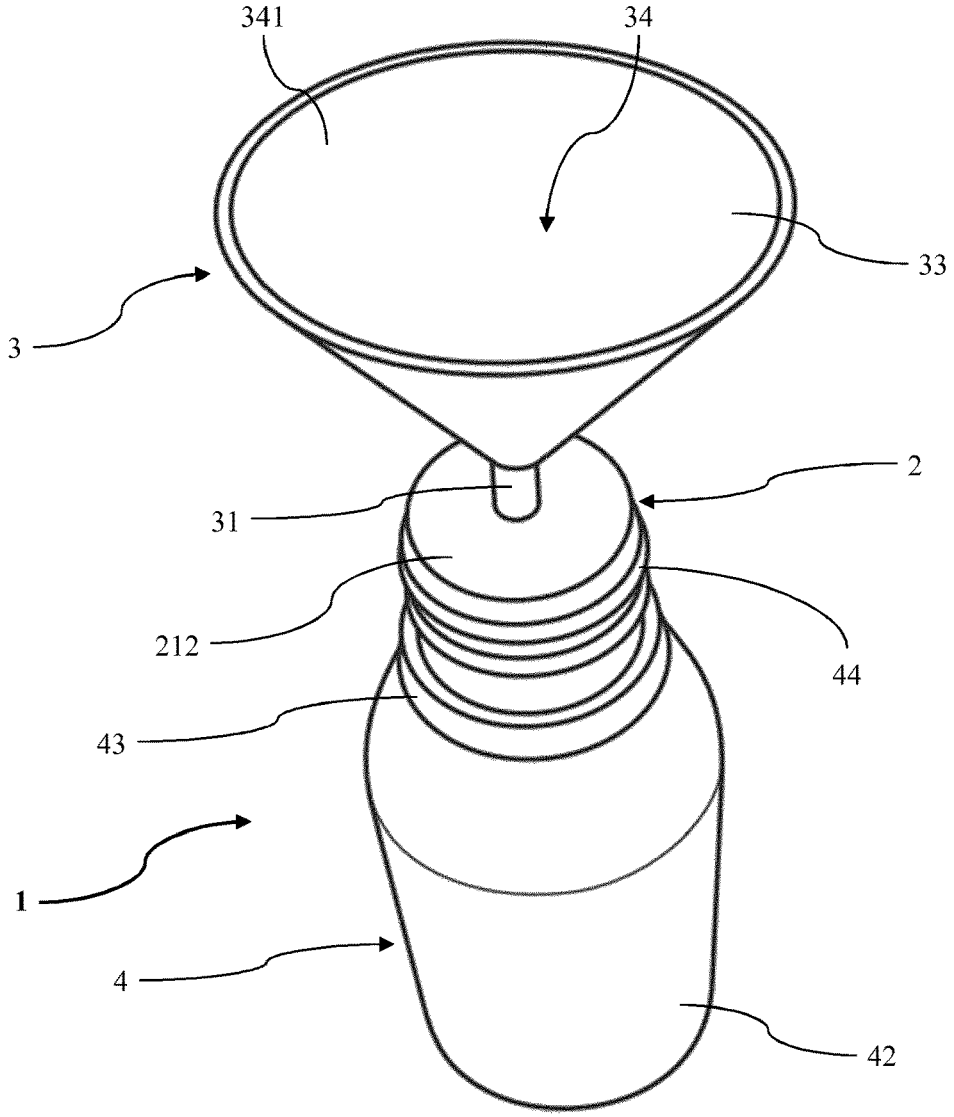
FIG. 5 shows a perspective view of a funnel of the drug preparation kit of FIG. 1 fitted into the adapter of the drug preparation kit of FIG. 1 mounted to the bottle of the drug preparation kit of FIG. 1.

FIG. 5 shows the adapter 2 being mounted to the bottle 4 and the funnel 3 being fitted into the adapter 2. In particular, the adapter 2 is press fitted into the opening 41 of the bottle 4 such that it is tightly closed. Then the neck portion 31 of the funnel 3 is fitted into the access passage 23 of the adapter 2 such that it extends from the out-container side 212 of the stud section 21 to its in-container side 211. More specifically it slightly projects below the in-container side into the interior of the bottle 4.

Figure 6:
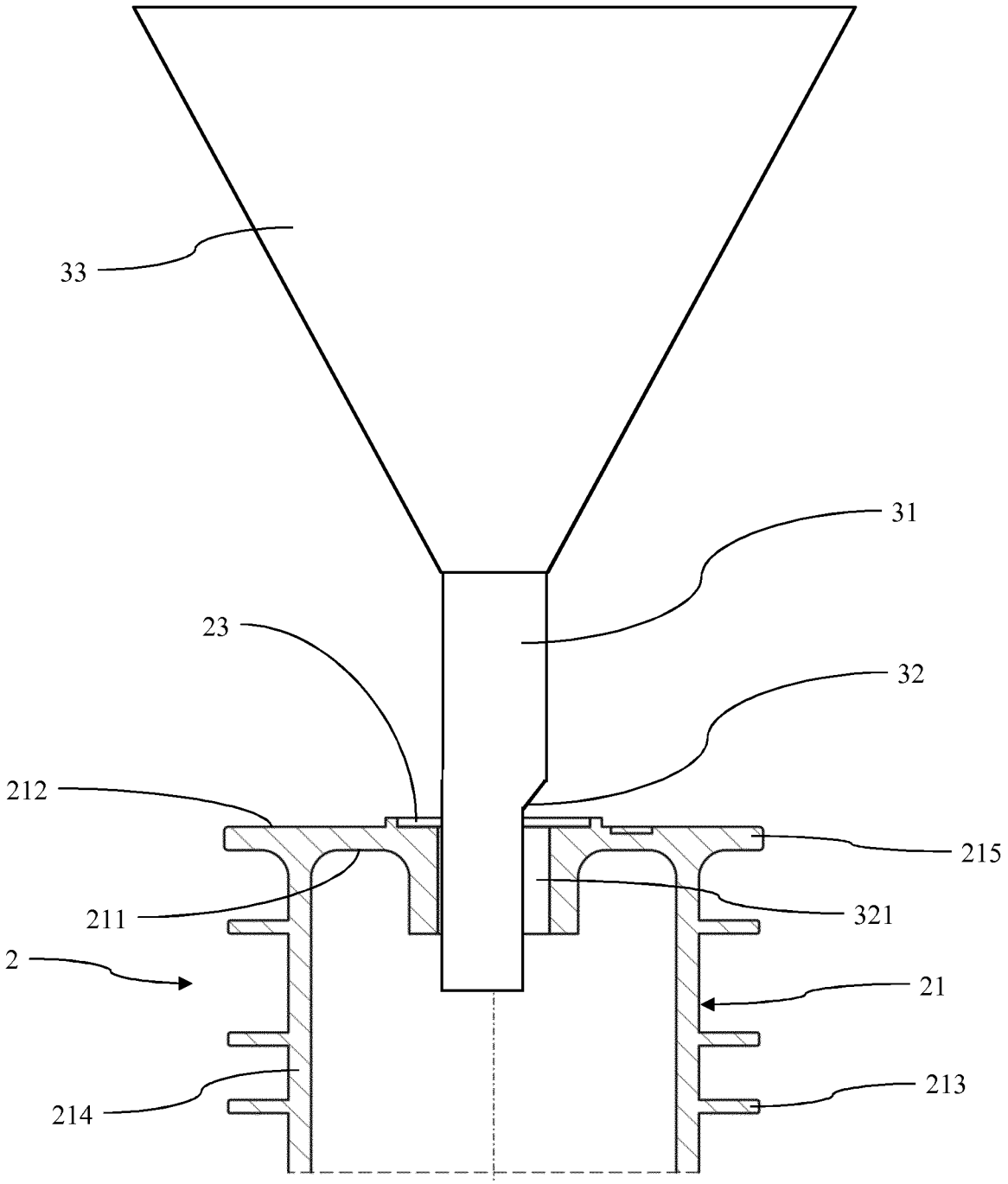
FIG. 6 shows a side view and cross section of the funnel of the drug preparation kit of FIG. 1 fitted into the adapter of the drug preparation kit of FIG. 1.

As can be seen in FIG. 6, the planar surface of the degassing channel formation 32 located at the neck portion 31 provides a degassing channel 321 along the neck portion 31 between the adapter 2 and the funnel 3. Except for where the degassing channel formation 32 is located, the neck 31 of the funnel 3 is tightly fitted and connected to the access passage 23 of the adapter 2. The liquid reconstitution medium is poured into the input aperture 341 and flows through the main duct 34 into the interior of the body 42 of the bottle 4. There, the drug powder is reconstituted. The gases generated or displaced during reconstitution smoothly exit via the degassing channel 321 formed by the degassing channel formation 32 as a portion of the access passage 22.

The kit 1 can be used in an embodiment of a process of preparing a highly potent drug product according to the invention as follows: A powder of a highly potent drug is obtained in the bottle 4. The adapter 2 is tightly fitted into the opening 41 of the bottle 4. The neck portion 31 of the funnel 3 is tightly fitted into the access passage 22 of the adapter 2. The reconstitution medium is provided into the bottle 2 via the funnel 3, wherein the degassing channel 321 generated by the degassing channel formation 32 extends from the in-container side 211 of the stud section 21 to its out-container side 212 such that the gas can exit the bottle 4 during reconstitution of the drug product inside the bottle 4 via the degassing channel 321.

After reconstitution, the funnel 3 is removed from the adapter 2 and the orifice 53 of the syringe 5 is fitted through the access passage 22 of the adapter 2. The bottle is then turned upside down and the liquid drug is withdrawn into the syringe 5 at a precise amount. Then the syringe 5 is removed from the adapter 2 and the liquid drug product is delivered via the orifice 53 to a patient.

Figure 7:
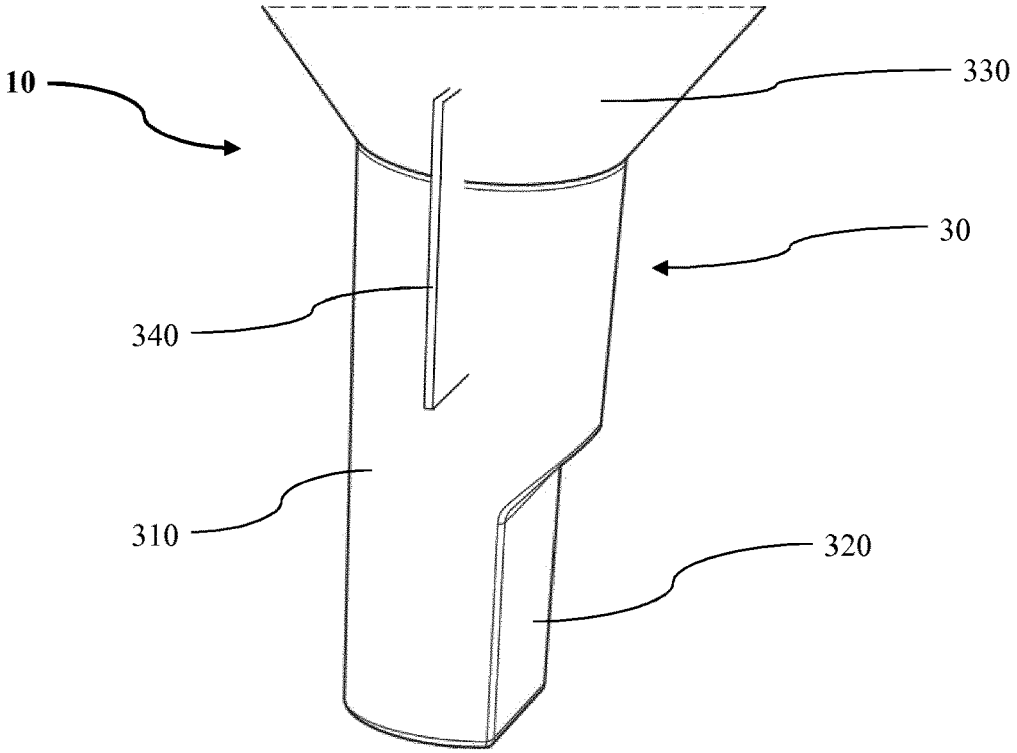
FIG. 7 shows a perspective view of a detail of a funnel of a second embodiment of a drug preparation kit according to the invention.

In FIG. 7 a second embodiment of a drug preparation kit 10 according to the invention is shown. Where not explicitly described below the kit 10 is essentially identical to the kit 1 described above in connection with FIGS. 1-5. The kit 10 comprises a funnel 30 which is embodied with a cone portion 330, a neck portion 310 and a degassing channel formation 320 comprising a planar surface at the neck portion 310. Further, the funnel 30 comprises a seat 340 adapted to stably hold the funnel 30 on the adapter, when the neck portion 310 is tightly fitted into an access passage of the adapter. The seat 340 has two opposite, wing like, vertical wall sections which outwardly project from the neck portion 310. When fitted in the access passage of the adapter, a lower end of the wall sections abut an out-container side of the adapter and allow the funnel 30 to be stably held.

Figure 8:
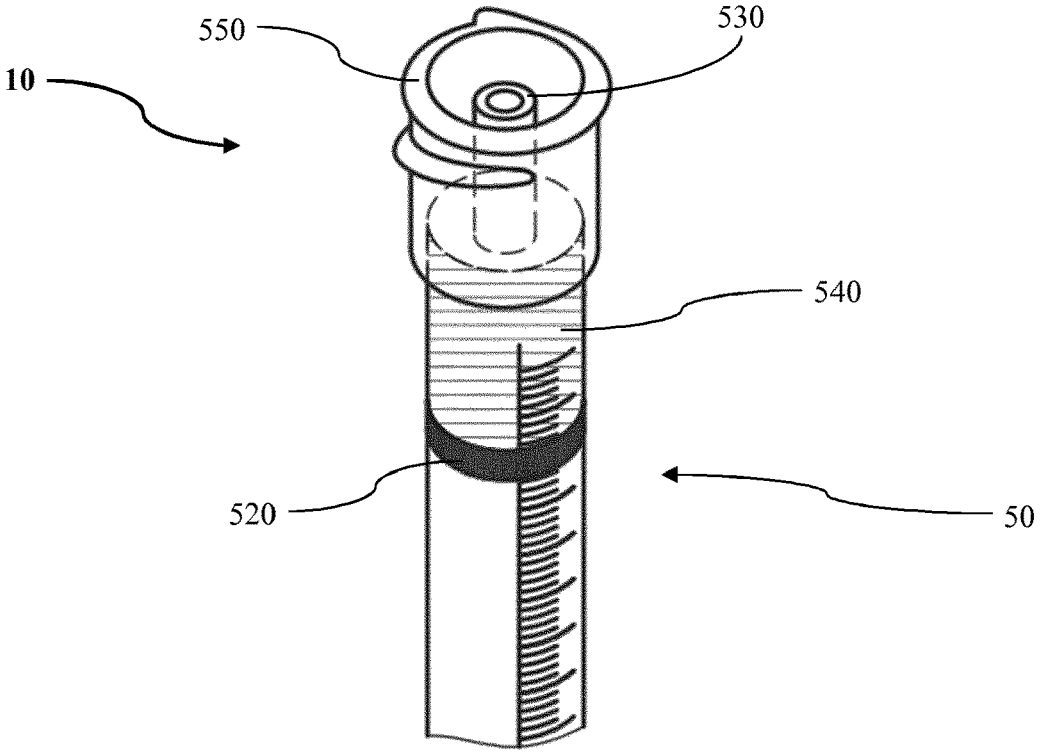
FIG. 8 shows a perspective view of a dispenser of the drug preparation kit of FIG. 6.

FIG. 8 shows a dispenser of the kit 10 being an enteral tube 50. The tube 50 comprises a hollow interior, a delivery orifice 530 and a plunger 520. Between the plunger 520 and the orifice 530 a dosage chamber is formed. Around the delivery orifice 530 a male part of an ENFit® connector 550 is arranged. An access passage of the adapter of the kit 10 is equipped with a corresponding female part of the ENFit® connector such that the enteral tube 50 can be safely connected to the adapter when it is mounted to a bottle of the kit 10.

This description and the accompanying drawings that illustrate aspects and embodiments of the present invention should not be taken as limiting the claims defining the protected invention. In other words, while the invention has been illustrated and described in detail in the drawings and foregoing description, such illustration and description are to be considered illustrative or exemplary and not restrictive. Various mechanical, compositional, structural, electrical, and operational changes may be made without departing from the spirit and scope of this description and the claims. In some instances, well-known circuits, structures and techniques have not been shown in detail in order not to obscure the invention. Thus, it will be understood that changes and modifications may be made by those of ordinary skill within the scope and spirit of the following claims.

The disclosure also covers all further features shown in the Figs. individually although they may not have been described in the afore or following description. Also, single alternatives of the embodiments described in the figures and the description and single alternatives of features thereof can be disclaimed from the subject matter of the invention or from disclosed subject matter. The disclosure comprises subject matter consisting of the features defined in the claims or the exemplary embodiments as well as subject matter comprising said features.

Furthermore, in the claims the word "comprising" does not exclude other elements or steps, and the indefinite article "a" or "an" does not exclude a plurality. A single unit or step may fulfil the functions of several features recited in the claims. The mere fact that certain measures are recited in mutually different dependent claims does not indicate that a combination of these measures cannot be used to advantage. The terms "essentially", "about", "approximately" and the like in connection with an attribute or a value particularly also define exactly the attribute or exactly the value, respectively. The term "about" in the context of a given numerate value or range refers to a value or range that is, e.g., within 20%, within 10%, within 5%, or within 2% of the given value or range. Components described as coupled or connected may be electrically or mechanically directly coupled, or they may be indirectly coupled via one or more intermediate components. Any reference signs in the claims should not be construed as limiting the scope.

The invention claimed is:

1. A drug preparation kit comprising:

an adapter including a stud section having an in-container side and an out-container side, the stud section being essentially cylindrical and having press-fit structures extending from an exterior thereof, the press-fit structures being dimensioned and arranged to be tightly pressed into an opening of a container, and an access passage that extends from the in-container side to the out-container side through the stud section; and a funnel unit including a cone portion being essentially frustum conically shaped;

a neck portion that extends from the cone portion and being dimensioned to fit into the access passage of the adapter, the neck portion defining at least a portion of a main duct through which a liquid is provided into the container, and the neck portion having a planar exterior surface that embodies a degassing channel formation extending upward from a bottom end of the neck portion, wherein when the neck portion of the funnel unit is fit into the access passage of the adapter, the degassing channel formation is configured to form a degassing channel between the degassing channel formation and the access passage from the in-container side to the out-container side of the stud section of the adapter.

2. The drug preparation kit according to claim 1, wherein except for where the degassing channel formation is located on the neck portion of the funnel unit, the neck portion of the funnel unit is tightly fitted and connected to the access passage of the adapter.

3. The drug preparation kit of claim 1, comprising the container with the opening, wherein the stud section of the adapter is dimensioned to fit into the opening of the container.

4. The drug preparation kit of claim 3, wherein the container is a bottle or a vial.

5. The drug preparation kit of claim 3, comprising a solid drug product arranged inside the container.

6. The drug preparation kit of claim 5, comprising a reconstitution medium for reconstituting the solid drug product.

7. The drug preparation kit of claim 6, wherein the reconstitution medium is controlled water.

8. The drug preparation kit of claim 5, wherein the solid drug product is highly potent.

9. The drug preparation kit of claim 1, comprising a dispenser adapted to be coupled to the access passage of the adapter for withdrawing a content of a container.

10. The drug preparation kit of claim 9, wherein the dispenser is a syringe, an enteral tube or a gastric tube.

11. The drug preparation kit of claim 1, wherein the funnel unit has a seat adapted to stably hold the funnel unit on the adapter when the neck portion of the funnel unit is tightly fitted into the access passage of the adapter.

12. The drug preparation kit of claim 1, wherein the access passage of the adapter is ENFit® compliant or Luer Lock compliant.

13. The drug preparation kit according to claim 1 configured for use in extemporaneous administration of a drug solution to a patient.

14. The drug preparation kit according to claim 13, wherein the drug solution is a highly potent drug solution.

* * * * *